US010499729B1

(12) United States Patent
Lavoie

(10) Patent No.: US 10,499,729 B1
(45) Date of Patent: Dec. 10, 2019

(54) LIFTING SYSTEM FOR USE WITH FURNITURE ELEMENTS FOR IMPROVING ERGONOMICS

(71) Applicant: Robert Lavoie, Chicoutimi (CA)

(72) Inventor: Robert Lavoie, Chicoutimi (CA)

( * ) Notice: Subject to any disclaimer, the term of this patent is extended or adjusted under 35 U.S.C. 154(b) by 34 days.

(21) Appl. No.: 16/035,590

(22) Filed: Jul. 14, 2018

(51) Int. Cl.

| | |
|---|---|
| ***A47B 9/04*** | (2006.01) |
| ***A47B 21/02*** | (2006.01) |
| ***A47B 9/16*** | (2006.01) |
| ***A47B 21/04*** | (2006.01) |

(52) U.S. Cl.
CPC ..... *A47B 9/04* (2013.01); *A47B 9/16* (2013.01); *A47B 21/02* (2013.01); *A47B 21/04* (2013.01); *A47B 2200/0039* (2013.01)

(58) Field of Classification Search
CPC .. A47B 9/04; A47B 9/08; A47B 9/083; A47B 9/16; A47B 9/20; A47B 21/02; A47B 21/04; A47B 2009/043; A47B 2009/046; A47B 2009/086; A47B 2200/0039; A47B 2200/004; A47B 2200/005; A47B 2200/0051; A47B 2200/0052; A47B 2200/0053; A47B 2200/0054; A47B 2200/0055; A47B 2200/0061; A47B 2200/0062
USPC ..... 108/20, 144.11, 147; 312/306, 312
See application file for complete search history.

(56) References Cited

U.S. PATENT DOCUMENTS

| | | | | |
|---|---|---|---|---|
| 2,368,748 | A * | 2/1945 | Doty | A47B 9/04 108/147 |
| 3,880,096 | A * | 4/1975 | Kaplan | A47B 9/04 108/141 |
| 4,315,466 | A * | 2/1982 | Boerigter | A47B 9/12 108/147 |
| 4,714,025 | A * | 12/1987 | Wallin | A47B 9/00 108/147 |
| 5,797,666 | A * | 8/1998 | Park | A47B 21/0073 312/223.3 |
| 6,467,830 | B1 * | 10/2002 | Cortright | B60R 13/06 296/26.04 |
| 8,256,359 | B1 | 9/2012 | Agee | |
| 8,671,853 | B2 | 3/2014 | Flaherty | |
| 9,332,839 | B2 | 5/2016 | Ringlein | |
| 10,321,755 | B1 * | 6/2019 | Sie | A47B 9/06 |
| 2012/0227642 | A1 * | 9/2012 | Sekikawa | A47B 9/10 108/147 |
| 2013/0293173 | A1 * | 11/2013 | Strothmann | A47B 9/20 318/466 |
| 2019/0110590 | A1 * | 4/2019 | Xiang | A47B 21/02 |

FOREIGN PATENT DOCUMENTS

| | | | | |
|---|---|---|---|---|
| EP | 1163862 | A1 * | 12/2001 | A47B 9/20 |

* cited by examiner

*Primary Examiner* — Joshua E Rodden

(57) ABSTRACT

A lifting system for use with furniture elements for improving ergonomics includes an electric linear actuator, a casing member, a pedestal structure, and a pair of rails. The pedestal structure is configured to travel telescopically inside the casing member via the pair of rails. A furniture element is positioned on the top the casing member. The furniture element, such as a table or desk, is configured to raise and lower via the electric linear actuator. The improved lifting system provides a cost effective solution to raise and lower the table or desk.

4 Claims, 5 Drawing Sheets

FIG. 4A
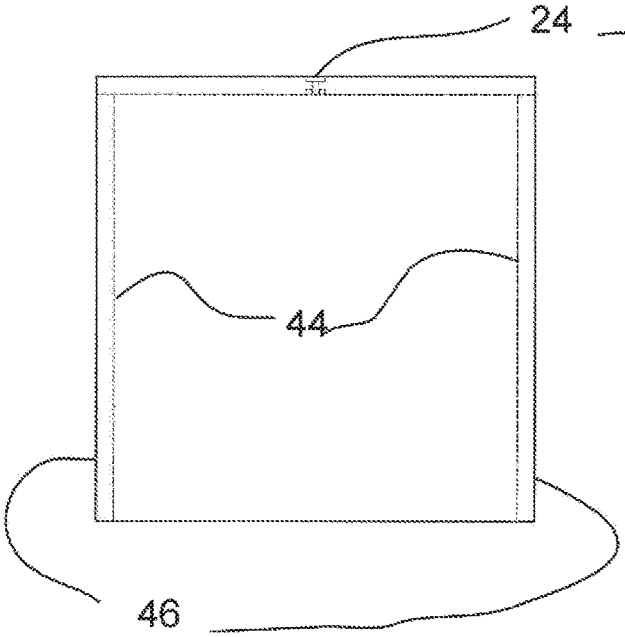
FIG. 4B
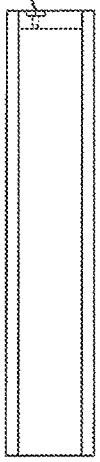
FIG. 4C
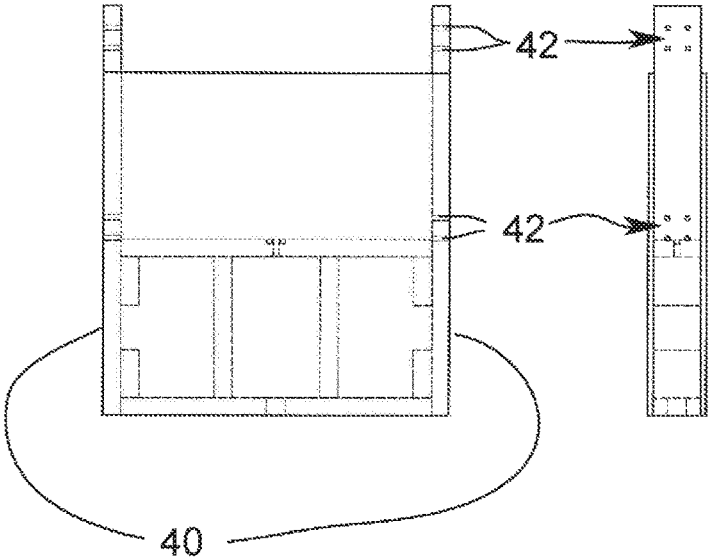
FIG. 4D

FIG. 5A
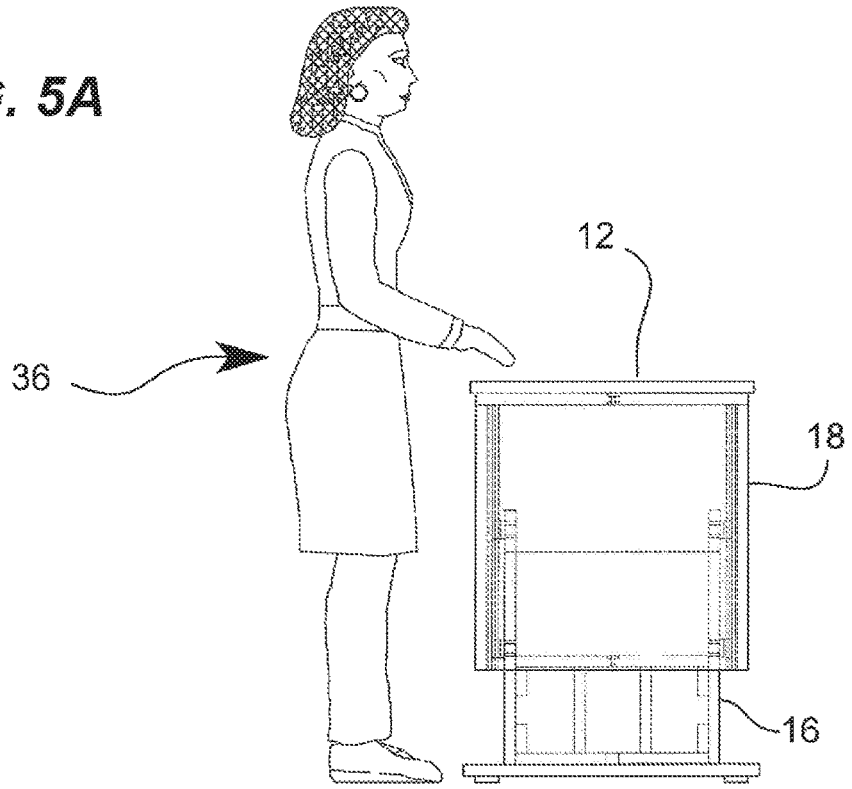
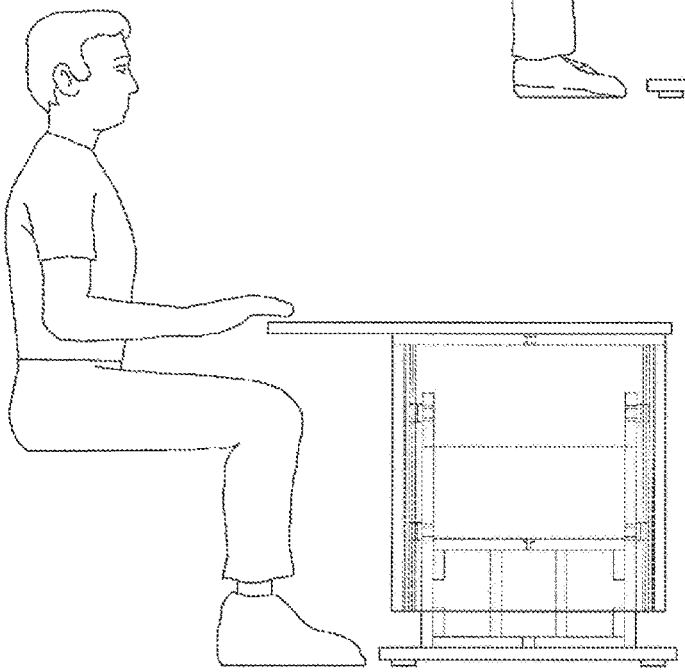
FIG. 5B

LIFTING SYSTEM FOR USE WITH FURNITURE ELEMENTS FOR IMPROVING ERGONOMICS

BACKGROUND OF THE INVENTION

1. Field of the Invention

The present invention relates generally to commercial, corporate and scientific furniture equipment but more particularly to a lifting system for use with furniture elements for improving ergonomics.

2. Description of Related Art

In various fields of activities, special furniture is required to optimize workflow. More and more notions of ergonomics are making their way into furniture design in the workplace. What has been found is that it is necessary for a worker to change body posture throughout the day. Often, this is something as simple as changing the way the arms interact with the handling of tools or equipment. Sometimes it implies shifting from a sitting position to a standing position. In order to encourage body position shifting while keeping optimal ergonomic posture, the work surface, such as a table or a desk, has to be raised or lowered. There are many companies specializing in ergonomic design and each have their own ways of tackling work related situations and ways to move elements of furniture so as to optimize ergonomic factors. A lot of those systems utilize very complicated electro-mechanical or hydraulic assisted systems to move components around, which makes the furniture quite expensive to purchase and difficult to maintain and service. Consequently, a low cost lifting system for use with furniture elements for improving ergonomics is needed.

BRIEF SUMMARY OF THE INVENTION

In one embodiment of the present invention a lifting system is provided, comprising an electric linear actuator; a casing member having an outer top surface, an inner top surface, a pair of inner side surfaces, and an open bottom; a pair of rails fastened to the pair of inner side surfaces; a pedestal structure having a pair of exterior sides, wherein an equal number of grooved blocks are fastened to each exterior side, wherein the grooved blocks are configured to engage and travel the pair of rails such that the pedestal structure is configured to travel telescopically inside the casting member; and, a furniture element positioned to the outer top surface of the casing member, the furniture element configured to raise and lower via the electric linear actuator.

In one embodiment, the furniture element is a table or desk. In one embodiment, the pedestal structure includes a framework assembly providing structural support to the pedestal structure and the lifting system. In another embodiment, the framework assembly includes a pair of horizontal frame members positioned between the pair of exterior sides, and at least one vertical rib positioned centrally between the pair of horizontal frame members. In yet another embodiment, the framework assembly includes reinforcement blocks positioned in four interior corners where the pair of exterior sides and the pair of horizontal frame members join. In one embodiment, the electric linear actuator comprises a piston member, top clevis member, and a bottom clevis member, wherein the top clevis member is connected to a top bracket section of the casing member and the bottom clevis member is connected to an upper horizontal frame member of the pair of horizontal frame members.

BRIEF DESCRIPTION OF THE SEVERAL VIEWS OF THE DRAWINGS

Other features and advantages of the present invention will become apparent when the following detailed description is read in conjunction with the accompanying drawings, in which:

FIGS. 4A-B are front and side views of the casing member respectively according to an embodiment of the present invention;

FIGS. 4C-D are front and side view of the pedestal structure respectively according to an embodiment of the present invention; and, FIGS. 5A-B are side views illustrating a raised and lower configuration of the lifting system in use according to an embodiment of the present invention.

DETAILED DESCRIPTION OF THE PREFERRED EMBODIMENT

The following description is provided to enable any person skilled in the art to make and use the invention and sets forth the best modes contemplated by the inventor of carrying out their invention. Various modifications, however, will remain readily apparent to those skilled in the art, since the general principles of the present invention have been defined herein to specifically provide a lifting system for use with furniture elements for improving ergonomics.

Figure 1:
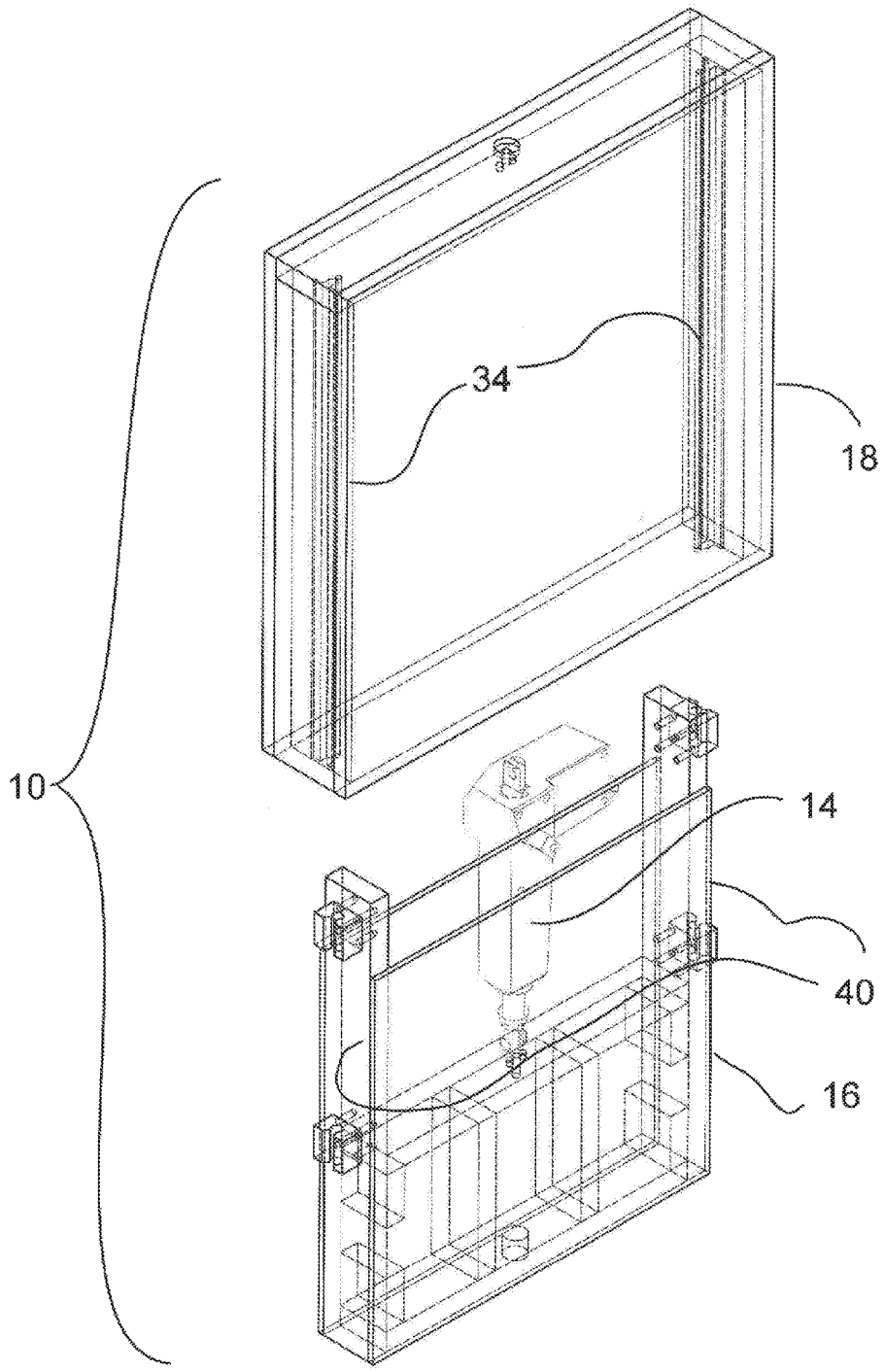
FIG. 1 is an isometric view of the lifting system showing the casing member and the pedestal structure according to an embodiment of the present invention.
Figure 2:
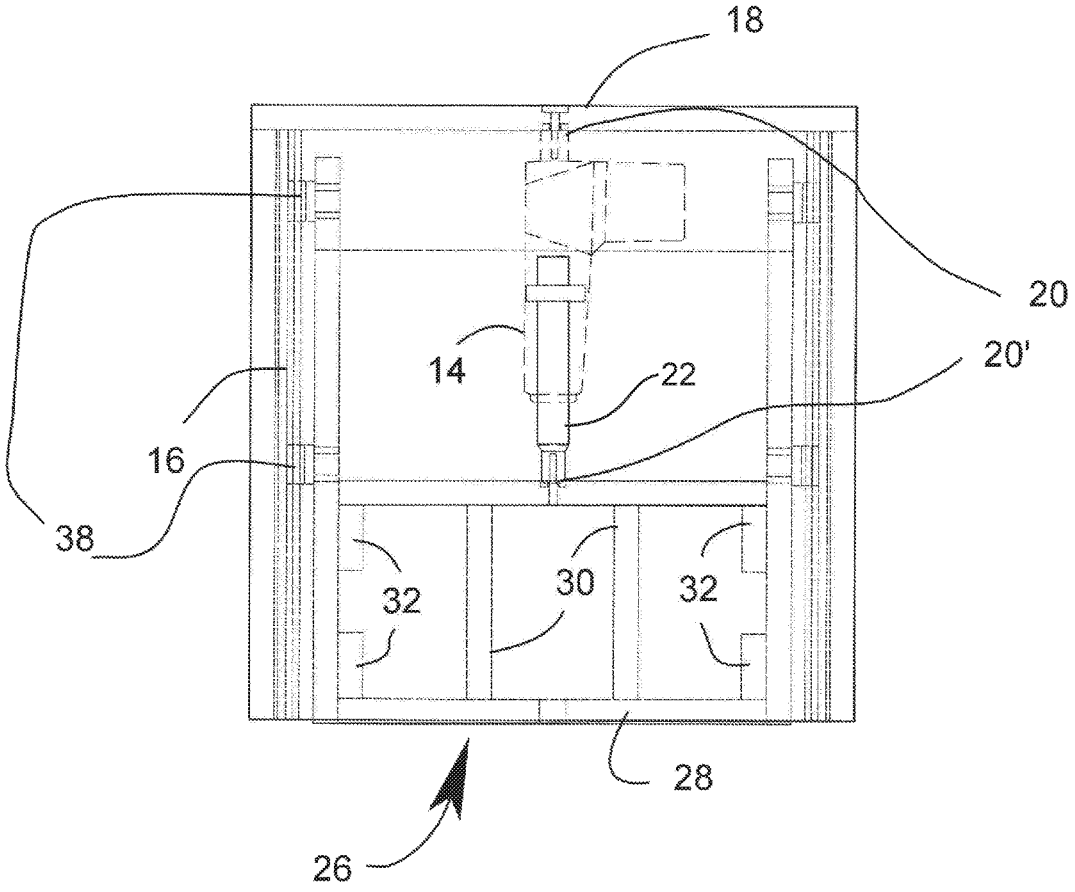
FIG. 2 is a front transparent view of the lifting system according to an embodiment of the present invention.
Figure 3:
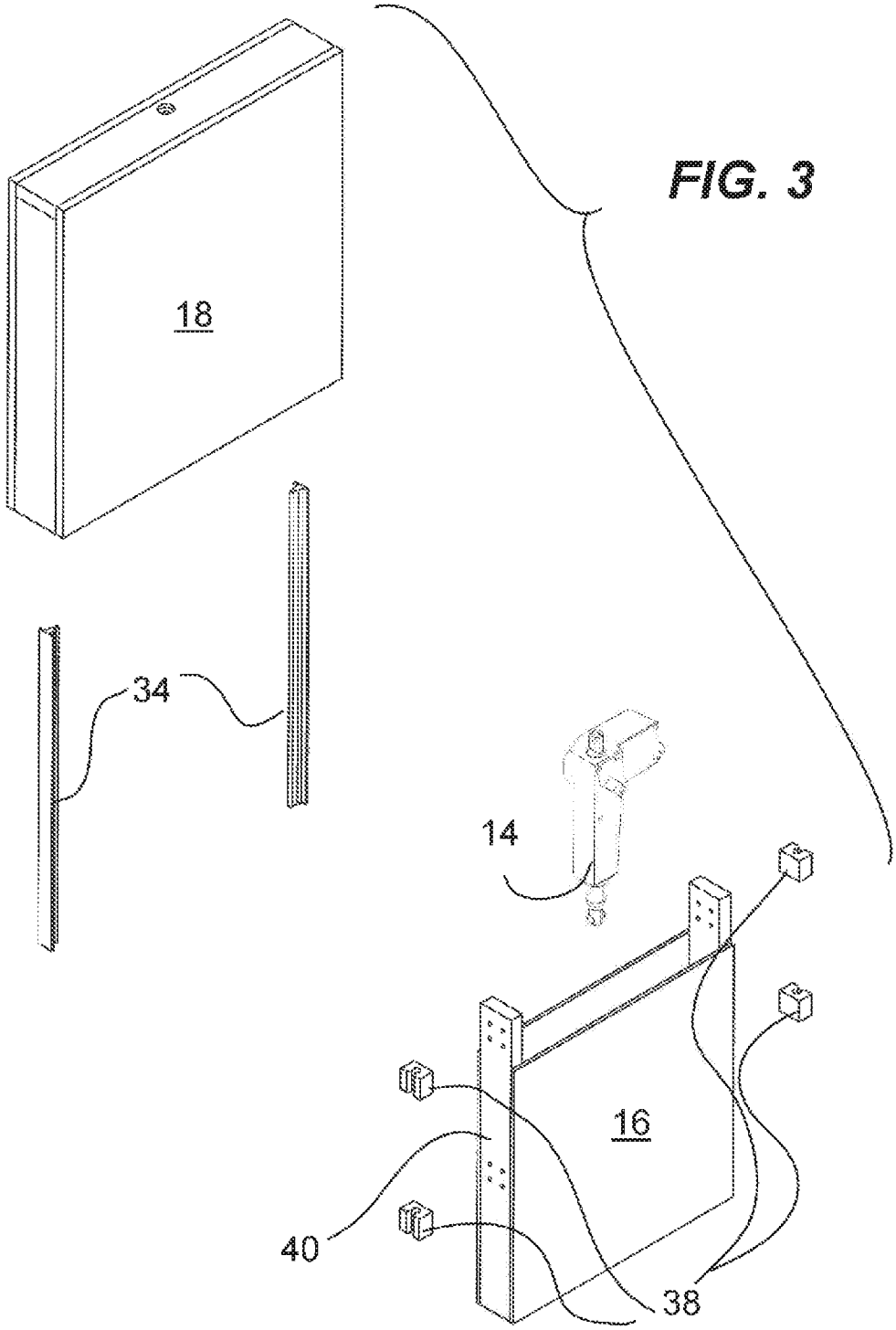
FIG. 3 is an exploded view of the lifting system according to an embodiment of the present invention.

Referring now to any of the accompanying FIGS. 1-5, a lifting system 10 for use with a furniture element 12 for improving ergonomics is illustrated. In one embodiment, the lifting system comprises an electric linear actuator 14 enclosed in a pedestal structure 16. In one embodiment, the pedestal structure is positioned telescopically inside casting member 18 forming part of furniture element 12.

In one embodiment, the electric linear actuator comprises top clevis member 20, bottom clevis member 20', and piston member 22. The top clevis and bottom clevis member are located on opposite ends of the electric linear actuator. In one embodiment, the top clevis member is connected to a top bracket section 24 of casing member 18. In one embodiment, the bottom clevis member is connected to framework 26 forming part of the interior of pedestal structure 16.

The framework is configured to provide structural integrity to the pedestal structure. This is critical as the framework must support the weight of the system, including but not limiting to the casing member, furniture element, and any objects placed on the furniture element, e.g. a computer system. In one embodiment, the framework comprises horizontal frame members 28, at least one rib 30, and reinforcement blocks 32. Preferably, the at least one rib is two ribs positioned centrally in between the horizontal frame members. Preferably, the reinforcement blocks are positioned in the four interior corners of the frame member.

In one embodiment, a pair of rails 34 are provided, wherein the pair of rails are configured to enable the pedestal structure to slide in and out of the casing member via grooved blocks 38. In one embodiment, the pair of rails are positioned on the interior side 44 of the casing member and the grooved blocks are positioned on the exterior sides 40 of the pedestal structure. In one embodiment, four grooved blocks are provided, a pair on each exterior side of the pedestal structure. In one embodiment, a plurality of holes positioned on the exterior sides 46 of the casing member are configured to receive mechanical fasteners, wherein the mechanical fasteners are configured to attach the casing member to the furniture element. In one embodiment, the furniture element is a desk.

Best seen in FIGS. 5A-B, the lifting system in use is illustrated, wherein FIG. 5A shows the lifting system in a raised position, and FIG. 5B shows the lifting system in a lower position. During use, a user 36 may activate a switch (not illustrated) to activate the lifting system such that the furniture element may be raised or lowered via the linear actuator. In one embodiment, more than one lifting system may be provided, depending on the size and weight requirements of the system. For instance, a pair of lifting systems may be provided, wherein each lifting system is installed at each end of the furniture element. In one embodiment, a control panel may be used to control the pair of lifting systems simultaneously.

Although the invention has been described in considerable detail in language specific to structural features and or method acts, it is to be understood that the invention defined in the appended claims is not necessarily limited to the specific features or acts described. Rather, the specific features and acts are disclosed as exemplary preferred forms of implementing the claimed invention. Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alternative embodiments will occur to those skilled in the art. Such variations and alternate embodiments are contemplated, and can be made without departing from the spirit and scope of the invention.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) are not used to show a serial or numerical limitation but instead are used to distinguish or identify the various members of the group.

What is claimed is:

1. A lifting system comprising:

an electric linear actuator;

a casing member having an outer top surface, an inner top surface, a pair of inner side surfaces, and an open bottom;

a pair of rails fastened to the pair of inner side surfaces;

a pedestal structure having a pair of exterior sides, wherein an equal number of grooved blocks are fastened to each exterior side, wherein the grooved blocks are configured to engage and travel the pair of rails such that the pedestal structure is configured to travel telescopically inside the casing member, wherein the pedestal structure includes a framework assembly providing structural support to the pedestal structure and the lifting system, and wherein the framework assembly includes a pair of horizontal frame members positioned between the pair of exterior sides, and at least one vertical rib positioned centrally between the pair of horizontal frame members; and, a furniture element positioned to the outer top surface of the casing member, the furniture element configured to raise and lower via the electric linear actuator.

2. The lifting system of claim 1, wherein the furniture element is a table or desk.

3. The lifting system of claim 1, wherein the framework assembly includes reinforcement blocks positioned in four interior corners where the pair of exterior sides and the pair of horizontal frame members join.

4. The lifting system of claim 1, wherein the electric linear actuator comprises a piston member, top clevis member, and a bottom clevis member, wherein the top clevis member is connected to a top bracket section of the casing member and the bottom clevis member is connected to an upper horizontal frame member of the pair of horizontal frame members.

* * * * *